US006249918B1

(12) United States Patent
Lacroix

(10) Patent No.: US 6,249,918 B1
(45) Date of Patent: Jun. 26, 2001

(54) HELMET

(75) Inventor: Philippe Lacroix, Nivelles (BE)

(73) Assignee: Cross, S.A., Nivelles (BE)

( * ) Notice: Subject to any disclaimer, the term of this patent is extended or adjusted under 35 U.S.C. 154(b) by 0 days.

(21) Appl. No.: 09/700,966

(22) PCT Filed: Jun. 2, 1999

(86) PCT No.: PCT/BE99/00069

§ 371 Date: Nov. 22, 2000

§ 102(e) Date: Nov. 22, 2000

(87) PCT Pub. No.: WO99/62365

PCT Pub. Date: Dec. 9, 1999

Related U.S. Application Data

(60) Provisional application No. 60/098,739, filed on Sep. 1, 1998.

(30) Foreign Application Priority Data

Jun. 2, 1998 (BE) ..... 09800421

(51) Int. Cl.[7] ..... A42G 1/08
(52) U.S. Cl. ..... 2/424; 2/6.5
(58) Field of Search ..... 2/424, 6.3, 6.4, 2/6.5, 425

(56) References Cited

U.S. PATENT DOCUMENTS

| | | | |
|---|---|---|---|
| 4,532,658 | * | 8/1985 | Zago . |
| 4,667,348 | * | 5/1987 | Sundahl . |
| 5,084,918 | * | 2/1992 | Breining et al. . |
| 5,301,372 | * | 4/1994 | Matoba . |
| 5,394,566 | | 3/1995 | Hong . |
| 5,584,073 | * | 12/1996 | Radzelovage et al. . |

FOREIGN PATENT DOCUMENTS

| | | | |
|---|---|---|---|
| 70 35 512 | | 3/1971 | (DE) . |
| 79 17 584 | | 9/1979 | (DE) . |
| 2937356 | * | 4/1980 | (DE) . |
| 28 53 260 | | 6/1980 | (DE) . |
| 196 12 724 | | 10/1997 | (DE) . |
| 0 433 182 | | 6/1991 | (EP) . |
| 0 479 406 | | 4/1992 | (EP) . |
| 0 590 255 | | 4/1994 | (EP) . |
| 0 638 253 | | 2/1995 | (EP) . |
| 0 895 726 | | 2/1999 | (EP) . |
| 2532528 | * | 3/1984 | (FR) . |
| 2 729 056 | | 7/1996 | (FR) . |
| 2052244 | * | 1/1981 | (GB) . |
| 1299559 | * | 3/1987 | (SU) . |
| 99/00069 | | 6/1999 | (WO) . |

* cited by examiner

*Primary Examiner*—Rodney Lindsey
(74) *Attorney, Agent, or Firm*—Laff, Whitesel & Saret, Ltd.; J. Warren Whitesel

(57) ABSTRACT

A helmet comprising a shell and a chin guard. The chin guard has a first lateral portion, a second lateral portion and a front portion positioned between the first and second lateral portions, said chin guard being hingedly mounted to the shell and moveable between an open position and a closed position. The chin guard has a locking mechanism for locking the chin guard to the shell in the closed position. The locking mechanism comprises a first locking member applied at the first lateral portion and provided for engaging the shell in a locking position; a second locking member applied at the second lateral portion and provided for engaging the shell in the locking position; and an actuating member connected to said first and second locking members and provided for actuating the first and second locking members. The front portion has a first cavity and a second cavity faced towards each other. The actuating member comprises spaced apart first and second buttons located in said first and second cavities and provided to be pressed towards each other in order to actuate the locking members.

11 Claims, 5 Drawing Sheets

HELMET

This application is a 371 of PCT/BE99/00069, filed Jun. 2, 1999, which claims benefit of U.S. Ser. No. 60/098,739, filed Sep. 1, 1998.

The present invention relates to a helmet with a shell, a chin guard hingedly mounted to the shell and a locking mechanism for locking the chin guard to the shell in a closed position.

U.S. Pat. No. 4,794,652 discloses a safety helmet wherein the locking mechanism comprises swivel bolts located at both extremities of the chin guard. The swivel bolts engage a locking member provided on the inside of the shell and is releasable against the force of a loading spring. For moving the chin guard from the closed to the open position, both swivel bolts need to be moved in an unlocking position, requiring the two hands from the operator.

EP 0 518 178 discloses a full face helmet having a chin guard that can be opened with just one hand by acting on a lever with the thumb. The lever protrudes in front of and outside the chin guard, which could cause an accidental opening of the chin guard in case of impact. This system is therefore not sufficiently reliable.

EP 0 895 726 having an earlier priority date than the present application, but published after the priority date of the present application, discloses a helmet wherein the actuating member operating the locking members is located inside the chin guard and may be operated with one hand. While providing a reliable closure system, this helmet suffers from the problem that the actuating member is not easily accessible.

The present invention aims to provide a helmet comprising an openable chin guard, which is reliable in case of impact, and wherein the locking mechanism is easily accessible and may be operated with one hand.

This object is achieved with the helmet according to the present invention comprising a shell and a chin guard. The chin guard has a first lateral portion, a second lateral portion and a front portion positioned between the first and second lateral portions. The chin guard is hingedly mounted to the shell and moveable between an open position and a closed position. The chin guard has a locking mechanism for locking the chin guard to the shell in the closed position. The locking mechanism comprises a first locking member applied at the first lateral portion; a second locking member applied at the second lateral portion; and an actuating member connected to said first and second locking members and provided for actuating the first and second locking members. The front portion has a first cavity and a second cavity. The actuating member comprises spaced apart first and second buttons located in said first and second cavities and provided to be pressed towards each other for moving the locking members in the unlocking position.

By providing that the cavities are located in the front portion of the chin guard and that the locking members can be simply unlocked by pressing the two buttons towards each other, a reliable mechanism which can be operated with two fingers of one hand is provided. The closure system is in addition easily accessible since the buttons are located in the cavities in the chin guard front portion.

In a preferred embodiment, the actuating member is connected to the locking members with tie rods. This provides a reliable transmission mechanism from the push buttons to the locking members.

The locking members are in particular formed by levers hingedly mounted to the chin guard.

Preferably, the locking mechanism further comprises a support member fixed to the chin guard, and the locking member is hingedly fixed to the support member. This facilitates the assembly of the locking mechanism. The support member, the locking members and the actuating member may be assembled together and then fixed on the inside of the chin guard.

For safety reasons, the helmet further preferably comprises means for holding the chin guard in the open position. This avoids an accidental closure of the chin guard, which could be dangerous in case a motorcyclist using such a helmet with the chin guard in the open position is driving.

Preferably, the helmet further comprises a first visor assembly hingedly mounted to the chin guard. This enhances the user flexibility, since it allows to open the first visor assembly, while maintaining the chin guard in the closed position. In particular, the helmet further comprises a second visor assembly hingedly mounted to the first visor assembly. This forms a helmet with a double visor wherein the first visor could be a conventional transparent visor, while the second visor is of a darker colour forming thereby a sun screen.

In order to facilitate the hinge movement of the second visor assembly with respect to the first visor assembly, the first visor assembly comprises a groove and the second visor assembly comprises a sliding button slideably mounted in the groove.

In a further preferred embodiment, the helmet further comprises resilient means between said first and second buttons for bringing the first and second buttons in a rest position. In order to open the chin guard, it will be sufficient to press the two buttons together against the load of the resilient means. When releasing the buttons, they will return automatically, with the load of the resilient means, to its initial position.

Ventilation to the inside of the helmet is ensured with ventilation means. These means contribute at the same time in demisting the visors.

A modular helmet is formed when the chin guard is removably mounted on said shell. When a user wishes to convert his helmet of the closed type to a helmet of the open type, he simply removes the chin guard from the shell.

Further details of the invention will now be described referring to the annexed drawings showing a preferred embodiment of the helmet according to the invention.

Figure 1:
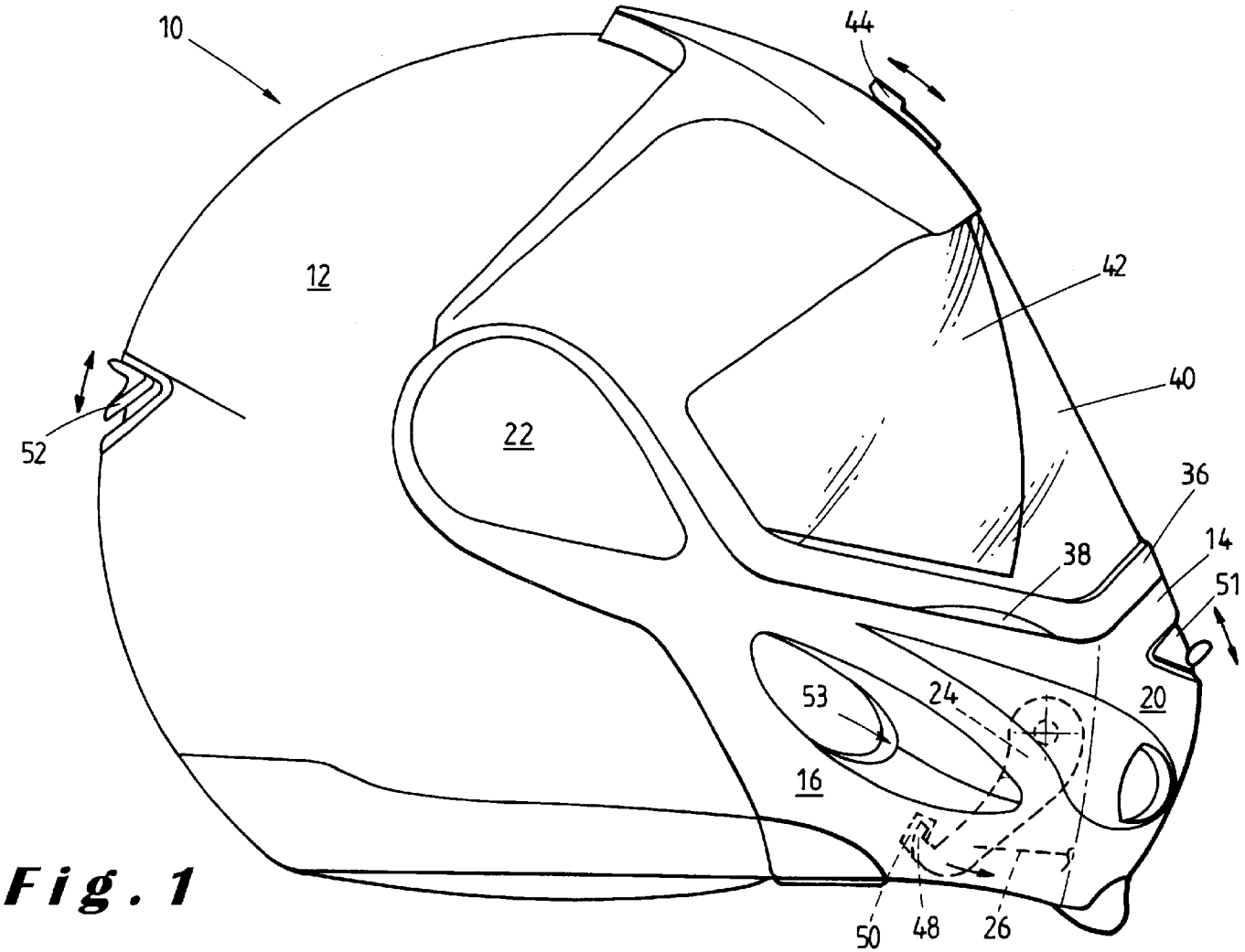
FIG. 1 is a side view of a helmet according to the invention with the chin guard in the closed position.

As shown in the figures, the helmet 10 is formed of a shell 12 and a chin guard 14. The shell is composed of an outer shell and a shock absorbing internal lining, as well known in the art. In the chin guard, three portions, delimited by the dotted lines, are defined: a first lateral portion 16, a second lateral portion 18 and a front portion 20. The front portion corresponds to the part of the chin guard covering the chin of the user. The lateral portions correspond to parts of the chin guard covering the cheeks of the user.

Figure 2:
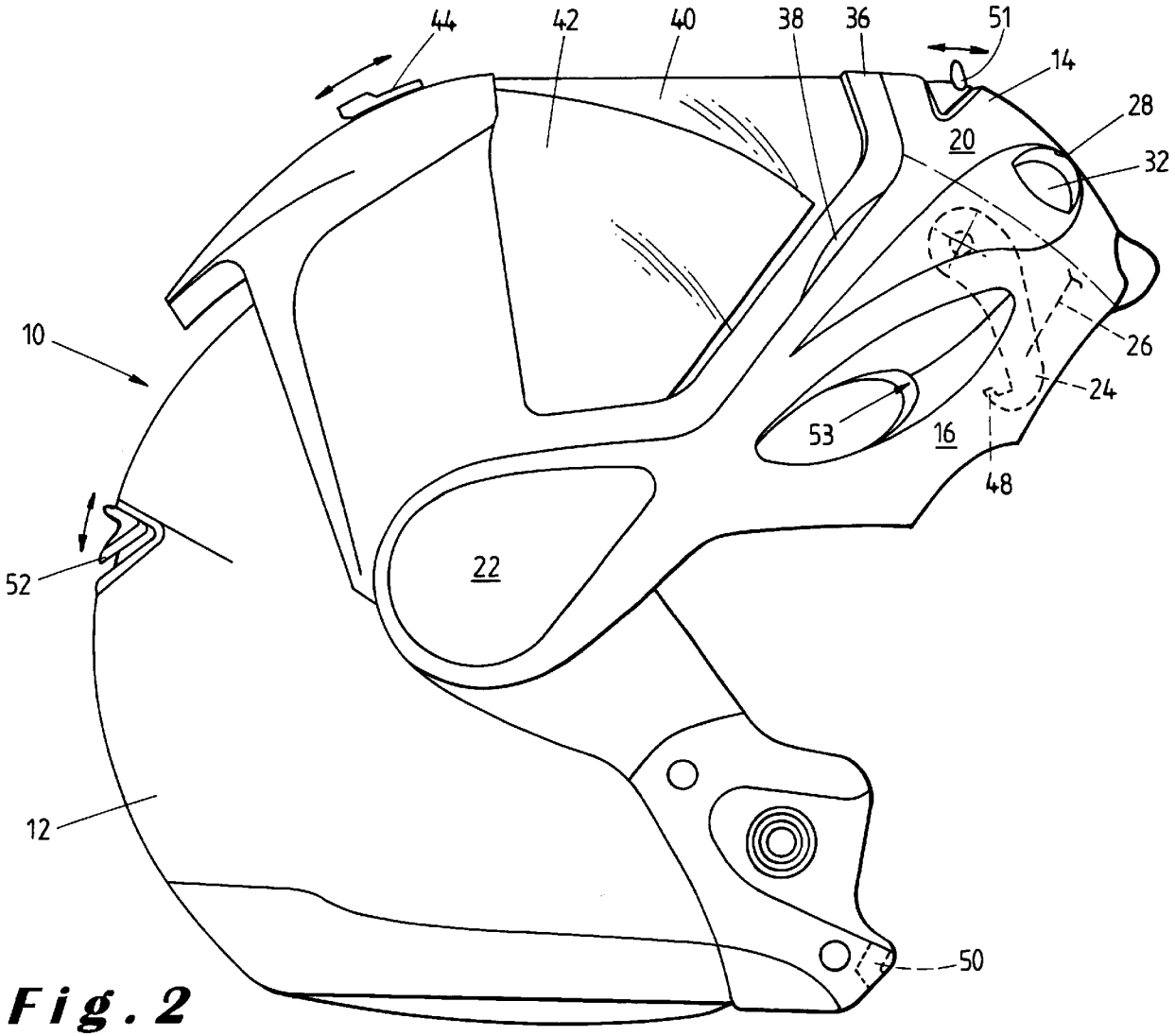
FIG. 2 is a side view of the helmet according to FIG. 1 with the chin guard in the open position.

The chin guard 14 is hingedly mounted to the shell 12 with a hinge mechanism 22, as further described in detail. The chin guard may be positioned between a closed position, as illustrated in FIG. 1 and an open position as illustrated in FIG. 2.

In order to lock the chin guard in the closed position, a locking mechanism is provided. The locking mechanism comprises a first locking member 24 located along the first lateral portion 16 and a second locking member 25 located along the second lateral portion 18 of the chin guard. Each locking member is preferably formed by a lever hingedly mounted to the chin guard. Each lever has a hook 48 provided for engaging a corresponding slot 50 located at an extremity of the shell 12, when the chin guard is brought to the closed position.

The locking members 24, 25 are actuated with an actuating member connected to the locking members. In the helmet according to the invention, the actuating member comprises a first button 32 and a second button 34, spaced apart from each other. The first and second buttons are located in corresponding first and second cavities 28, 30 located in the front portion of the chin guard. Preferably, the first and second buttons are spaced apart from each other with resilient means, in particular a spring 54, enabling to hold the locking members in the locking position. The locking members are connected with the actuating member preferably using tie rods 26.

Figure 3:
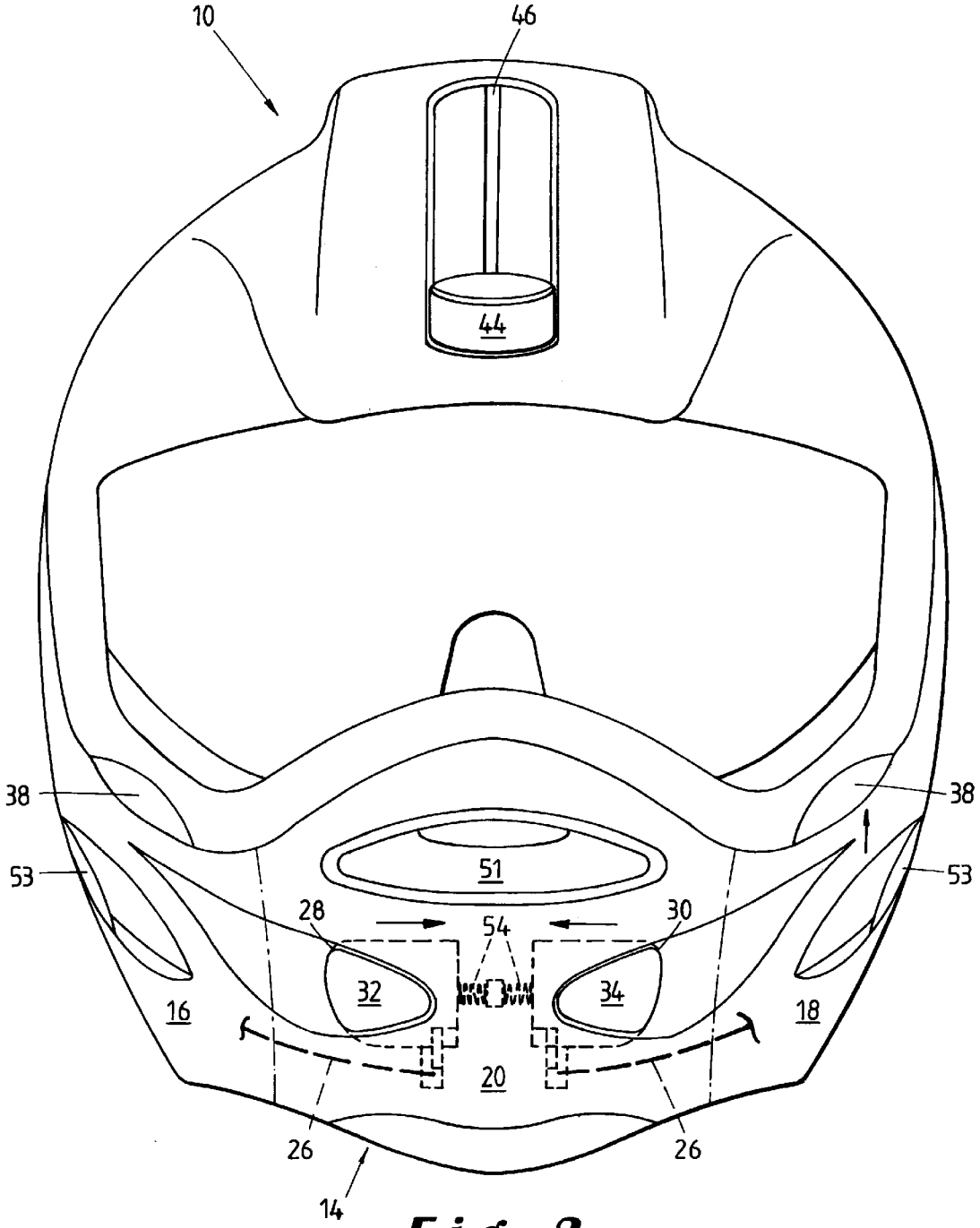
FIG. 3 is a front view of the helmet according to FIG. 1.

In order to raise the chin guard in the open position, the user presses the two buttons 32 and 34 towards each other, as indicated by the arrows in FIG. 3. As a result, the tie rods 26 will pull the levers in the direction as shown by the arrow in FIG. 1 disengaging hook 48 from its corresponding slot 50. The user can then easily pull the chin guard to the open position as shown in FIG. 2. When releasing the two buttons, they will return due to the spring load to the initial position. As a results, the levers are again brought in the locking position.

Figure 4:
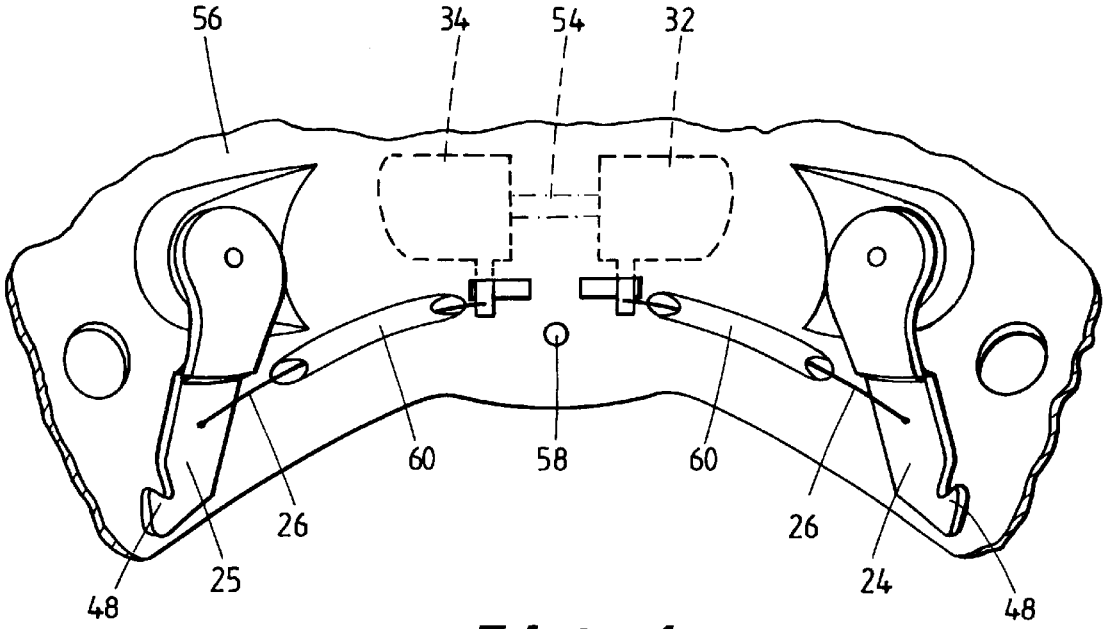
FIG. 4 is a plan view of the locking mechanism with support member mounted in the inside of the chin guard of the helmet according to FIG. 1.

The locking mechanism is preferably mounted on a support member 56, as shown in FIG. 4. The support member is fixed to the chin guard, for example using rivets. The rivets clamp protuberances located on the chin guard and passing through openings 58 provided in the support member. In FIG. 4, only a portion of the support member and only one of the openings have been illustrated. Each lever 24, 25 is hingedly mounted on the support member 56. The support member further preferably comprises sleeves 60 for guiding the tie rods 26 from the levers 24, 25 to the buttons 32, 34. A cover (not shown) in a foam like material is further fixed to the support member for protecting the chin of the user from the locking mechanism. The support member and locking mechanism can be assembled separately and then fixed to the chin guard. This facilitates mounting of the locking mechanism on the helmet.

Figure 5:
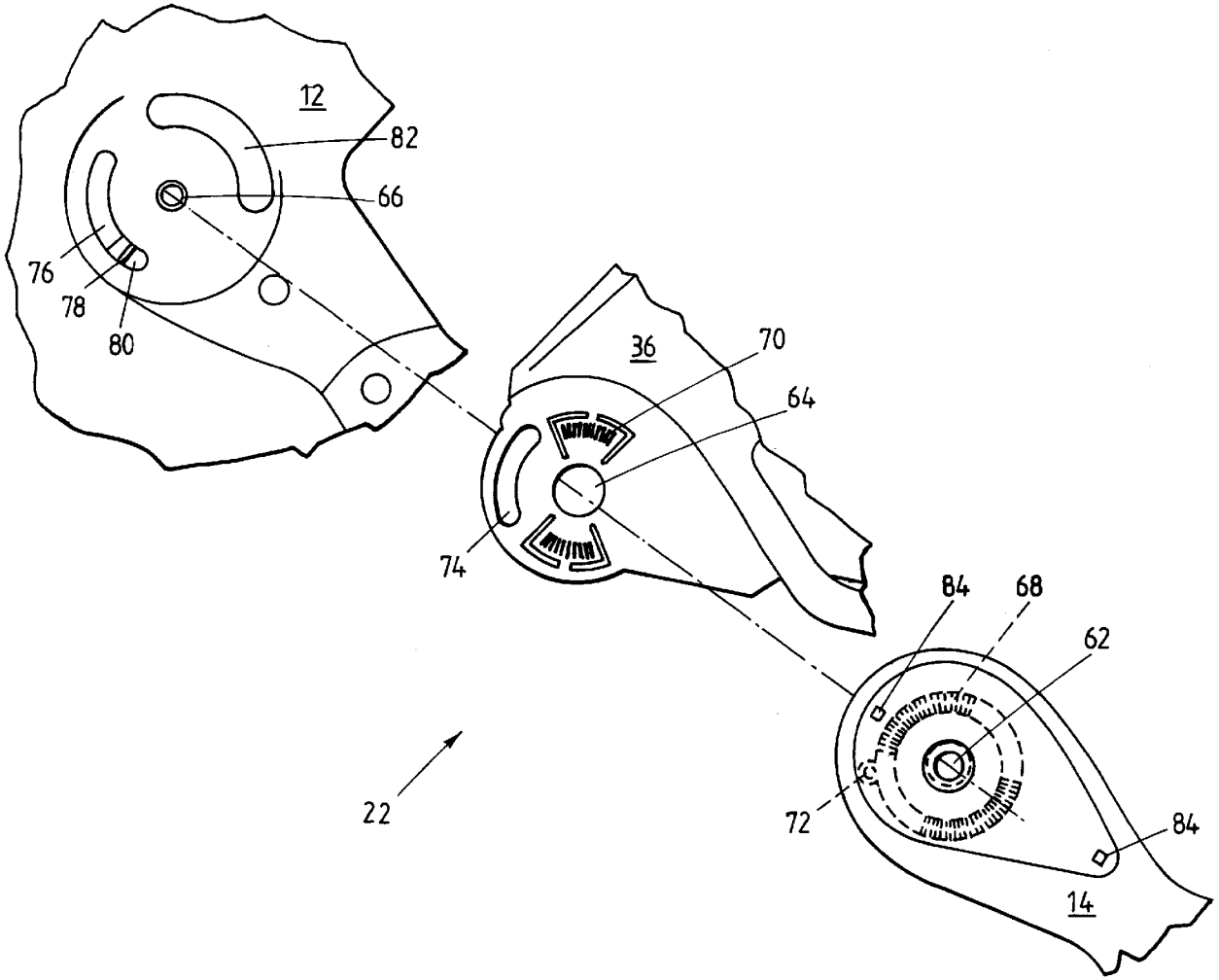
FIG. 5 is an exploded view of the hinge mechanism of the helmet according to FIG. 1.

FIG. 5 is an exploded view of the hinge mechanism 22, showing partially the helmet shell 12, first visor assembly 36 and chin guard 14. The hinge mechanism is not visible externally, since the chin guard is provided with openings 84 for receiving a cover plate (not shown). A bolt (not shown) passes through the openings 62 and 64 and is fastened to the threaded opening 66.

As already indicated, the first visor assembly 36 is hingedly connected to the chin guard. This is achieved by a toothed rack mechanism 68 and 70 comprising indentations 70 in the first visor assembly 36 mating into corresponding indentations 68 in the chin guard 14. This mechanism allows to hold the first visor assembly in several positions with respect to the chin guard. The user may easily open the first visor assembly simply by lifting the visor assembly at the height of at least one of the protrusions 38, as indicated with an arrow in FIG. 3.

The chin guard 14 is hingedly connected to the helmet shell 12. This is achieved by providing a protrusion 72 on the chin guard 14 extending through opening 74 and movable within slot 76 in the helmet shell. The opening 74 is shaped in such a manner to allow a hinge movement either between the first visor assembly 36 and the chin guard 14, or between the chin guard 14 and the shell 12. A prong 78 is preferably provided in slot 76, delimiting a compartment 80. Prong 78 is provided for locking the chin guard in the open position as illustrated in FIG. 2. Indeed, when opening the chin guard, protrusion 72 slides within slot 76 and reaches prong 78. When the user pulls the chin guard further open, protrusion 72 will pass over prong 78 and be locked in compartment 80.

Slot 82 is provided for receiving a screw (not shown) used for hingedly mounting the second visor assembly 42 to the first visor assembly 36. The second visor assembly is movable with respect to the first visor assembly by moving sliding button 44 in groove 46 provided in the first visor assembly.

The helmet is further provided with ventilating means 51, 52 and 53. In the back portion of the shell and the front portion of the chin guard, the ventilation means 51 and 52 are formed by an opening which may be closed with a cover. In the lateral portions of the chin guard, openings 53 are provided.

PARTS LIST

10 helmet
12 shell
14 chin guard
16 first lateral portion
18 second lateral portion
20 front portion
22 hinge mechanism
24 first locking member
25 second locking member
26 tie rod
28 first cavity
30 second cavity
32 first button
34 second button
36 first visor assembly
38 cavity
40 visor
42 second visor assembly
44 sliding button
46 groove
48 hook
50 slot
51, 52, 53 ventilation means
54 spring
56 support
58 opening
60 sleeve
62, 64, 66 openings

What is claimed is:

1. A helmet comprising:

a) a shell, b) a chin guard having a first lateral portion, a second lateral portion and a front portion positioned between the first and second lateral portions, said chin guard being hingedly mounted to the shell and moveable between an open position and a closed position;

c) the chin guard having a locking mechanism for locking the chin guard to the shell in the closed position, the locking mechanism comprising:

i) a first locking member applied at the first lateral portion and provided for engaging the shell in a locking position;

ii) a second locking member applied at the second lateral portion and provided for engaging the shell in the locking position; and iii) an actuating member connected to said first and second locking members and provided for actuating the first and second locking members;

wherein the front portion has a first cavity and a second cavity faced towards each other; and the actuating member comprises spaced apart first and second buttons located in said first and second cavities and provided to be pressed towards each other in order to actuate the locking members.

2. The helmet according to claim 1, further comprising resilient means between said first and second buttons for bringing the first and second buttons in a rest position.

3. The helmet according to claim 1, wherein the actuating member is connected to the locking members with tie rods.

4. The helmet according to claim 1, wherein the locking members are formed by levers hingedly mounted to the chin guard.

5. The helmet according to claim 1, wherein the locking mechanism further comprises a support member fixed to the chin guard, and wherein said locking member is hingedly fixed to the support member.

6. The helmet according to claim 1, further comprising means for holding the chin guard in the open position.

7. The helmet according to claim 1, further comprising a first visor assembly hingedly mounted to the chin guard.

8. The helmet according to claim 7, further comprising a second visor assembly hingedly mounted to the first visor assembly.

9. The helmet according to claim 8, wherein the first visor assembly comprises a groove and the second visor assembly comprises a sliding button slideably mounted in the groove.

10. The helmet according to claim 1, further comprising ventilation means.

11. The helmet according to claim 1, wherein the chin guard is removably mounted on said shell.

* * * * *